United States Patent [19]

Pierce

[11] 4,195,686

[45] Apr. 1, 1980

[54] HEAT EXCHANGER AIR DEFLECTORS

[75] Inventor: Linden W. Pierce, Rome, Ga.

[73] Assignee: General Electric Company, New York, N.Y.

[21] Appl. No.: 920,558

[22] Filed: Jun. 29, 1978

[51] Int. Cl.[2] ..... F28F 13/06

[52] U.S. Cl. ..... 165/1; 165/122; 165/DIG. 5; 336/55

[58] Field of Search ..... 165/DIG. 5, 122, 1; 336/55, 57, 58

[56] References Cited

U.S. PATENT DOCUMENTS

| | | | |
|---|---|---|---|
| 1,862,219 | 6/1932 | Harrison | 165/122 X |
| 2,320,207 | 5/1943 | Wilson | 165/122 |

FOREIGN PATENT DOCUMENTS

| | | | |
|---|---|---|---|
| 47368 | 12/1936 | France | 165/122 |

*Primary Examiner*—Albert W. Davis

*Attorney, Agent, or Firm*—Francis X. Doyle; Richard A. Menelly

[57] ABSTRACT

The invention is an improved heat exchanger of the type used for cooling electrical apparatus and having a plurality of headers and interconnecting cooling tubes arranged perpendicular to the headers and includes at least one fan to direct air over a portion of the cooling tubes. The improvement in thermal rating is obtained by the use of air deflectors to redirect the airflow over an additional portion of the cooling tubes.

14 Claims, 10 Drawing Figures

A
B
A
7e
7d
7c
J'
I'
H'
G'
18
19
3
8
B
A
7a
7b
18

18
19
3
8
A
B
A
7d
B
7c
7a
7b
18

HEAT EXCHANGER AIR DEFLECTORS

BACKGROUND OF THE INVENTION

Vaporization cooled apparatus such as transformers usually employ a heat exchanger for receiving the coolant in vaporized form and for returning the coolant in condensed form. The heat exchanger is usually cooled by natural air convection. Fans can be added to increase the heat exchanger rating required during overloads of the electrical apparatus. A suitable heat exchanger is described in U.S. patent application Ser. No. 862,352 entitled "Improved Heat Exchanger for Vaporization Cooled Transformer" filed Dec. 20, 1977. With this type heat exchanger it has been discovered that the natural convection rating is a maximum if the tubes are increased in length and a lesser number of rows of tubes are used. Whenever a lesser number of rows of tubes are used, however, an increased number of fans are required during overloads because the air from each fan 8 contacts only a small number of the rows of tubes.

Whenever the heat exchanger tubes are made sufficiently long, however, braces must be added to the tubes to prevent destructive vibration during shipment and during operation. Prior art heat exchangers for mineral oil immersed transformers include vibration braces bolted or welded to the cooling tubes. The fans are usually mounted between the braces since the braces may impede the air flow from the fans.

The purpose of this invention is to optimally direct the cooling airflow over a greater area of the heat exchanger surface in order to improve the heat exchanger efficiency and to reduce the number of fans required.

SUMMARY OF THE INVENTION

Air deflectors attached to heat exchanger cooling tubes in a predetermined arrangement are used to redirect the cooling air flow over an increased area of the heat exchanger surface to correspondingly increase the ratings of the heat exchangers when used with electrical apparatus.

GENERAL DESCRIPTION OF THE INVENTION

Figure 1:
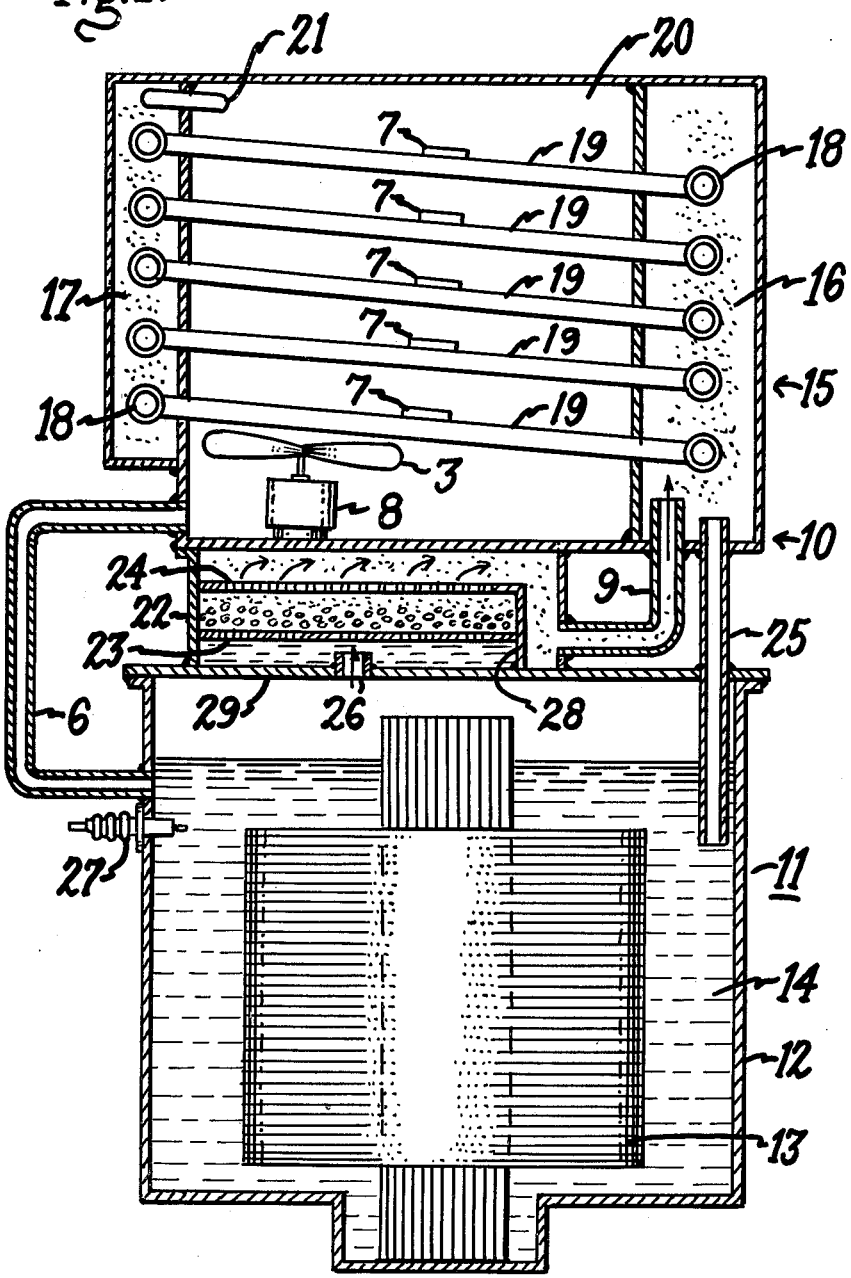
FIG. 1 is a front sectional view of a transformer assembly using the improved heat exchanger of the invention.

FIG. 1 contains a transformer cooling apparatus 10 employing the novel heat exchanger arrangement 15 of the invention. The apparatus includes a boiler 11 consisting of a tank 12 containing a coolant 14 and a transformer 13. Electrical feedthrough bushing 27 is provided in one side of the tank 12 for electrical connection with transformer 13. Heat exchanger 15 employs an entrance manifold 16, and exit manifold 17, a series of parallel headers 18 and a plurality of interconnecting cooling tubes 19. Expansion tank 20 can contain a noncondensable dielectric gas for providing an electrically insulating medium for transformer 13 when the coolant 14 is in a liquid nonevaporative state. The expansion tank 20 is connected to exit manifold 17 by means of conduit 21 and condensate return pipe 6. Condensate return pipe 6 serves to return any condensate of coolant 14 which forms in expansion tank 20 due to changes in ambient air temperature from the expansion tank 20 to tank 12. Tank 12 connects with heat exchanger 15 by means of chamber 22 which also houses a container 23 full of particulate molecular sieve 24 for removing any condensable material impurities from coolant 14. Additional impurities become collected within trap 29 subjacent to container 23 which is porous. The use of a molecular sieve absorbent in the vapor stream of a condensable coolant is more fully described in U.S. patent application Ser. No. 843,676, filed Oct. 19, 1977, entitled "Percolation Cooled Electrical Transformers", which application is incorporated herein by way of reference. Chamber 22 is connected to entrance manifold 16 by means of entrance conduit 9 and return pipe 25. Chamber 22 connects with tank 12 via inlet 26 connecting through the top of tank 12.

Figure 3:
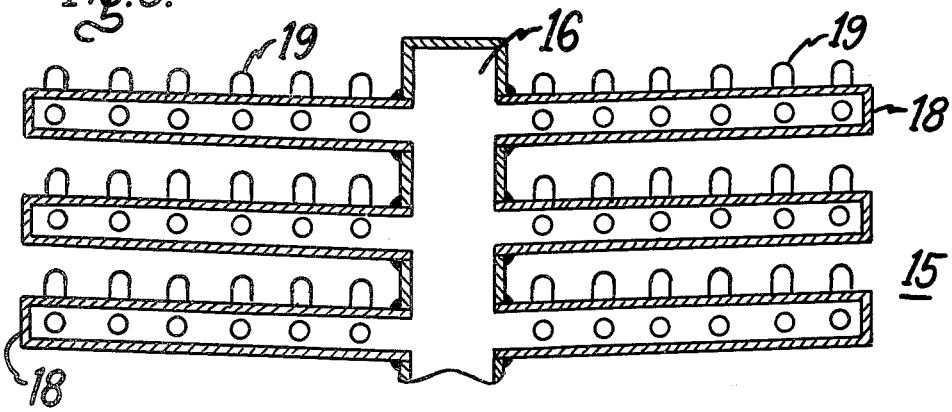
FIG. 3 is a side sectional view of the heat exchanger of FIG. 2.

The vapor transmission path for coolant 14 is indicated by directional arrows and proceeds as follows. When transformer 13 becomes energized, coolant 14 becomes heated and passes through inlet 26 in vapor form to chamber 22. The vaporized coolant 14 then proceeds through molecular sieve material 24 over the solid barrier 28 up into the entrance manifold 16 via entrance conduit 9. The vaporized coolant 14 passes through entrance manifold 16 into parallel headers 18 and out to cooling tubes 19. The coolant 14 readily condenses within cooling tubes 19 and returns to tank 12 in liquid form via headers 18, entrance manifold 16, and return pipe 25. Return pipe 25 extends a lesser height into entrance manifold 16 than entrance conduit 9 so that the condensed coolant 14 returns through return pipe 25 instead of through entrance conduit 9. Coolant 14 in vapor form is prevented from bypassing the sieve material 24 by means of the aforementioned solid barrier 28. Inlet 26 extends above the surface of tank 12 to prevent liquid contaminants within trap 29 from entering back into tank 12. Return pipe 25 and entrance conduit 9 also extend above the bottom of entrance manifold 16 to form an additional contaminant trap in the bottom of entrance manifold 16. For the purpose of the embodiment of FIG. 1, the cooling tubes 19 are mounted nearly horizontal within heat exchanger 15 in order to improve the natural convection thermal transfer efficiency and to reduce the overall height of the apparatus 10. Tubes 19 are slightly inclined between headers 18 to provide for drainage of the condensate of coolant 14. Headers 18 are also inclined in order to facilitate drainage of the condensate of coolant 14 back into the entrance manifold 16 and from there into tank 12. The inclination of the headers 18 is clearly shown in FIG. 3. A fan 8 forces air over the tubes 19 to increase the rating when required. Air deflectors 7 direct the air over the tubes 19 in an efficient pattern which will now be described in detail.

DESCRIPTION OF THE PREFERRED EMBODIMENT

Figure 2:
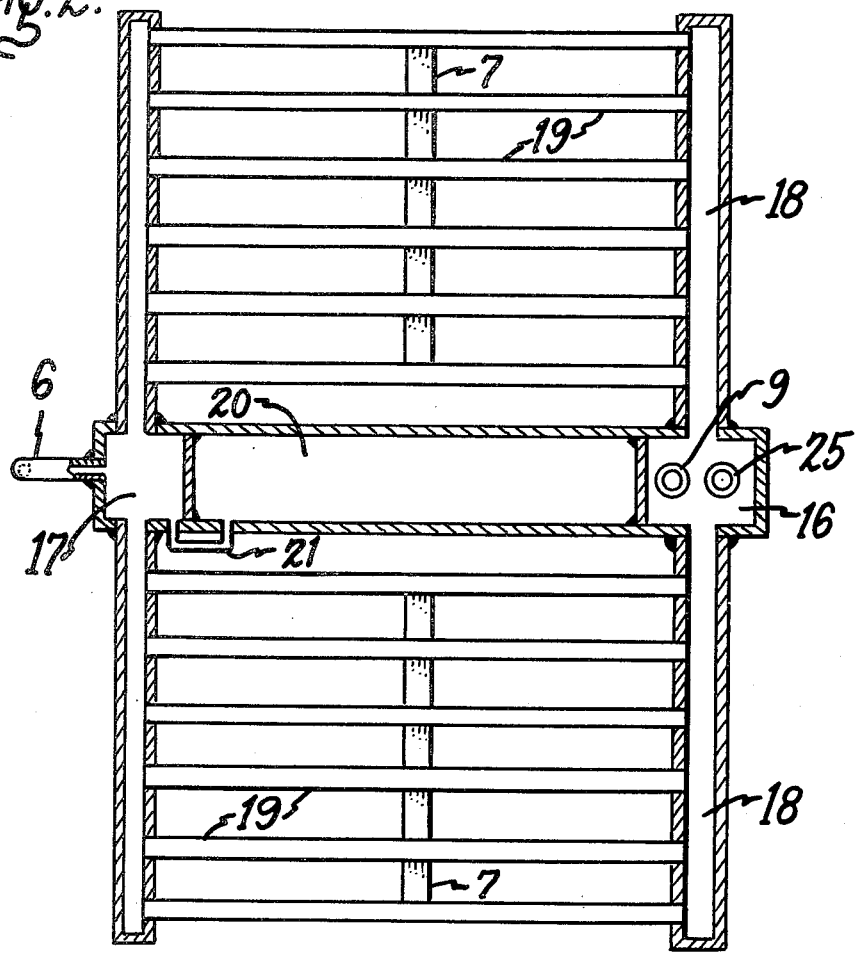
FIG. 2 is a top sectional view of the heat exchanger of FIG. 1.

The efficient heat exchanger 15 of the invention can be seen in additional detail in FIG. 2. One layer of cooling tubes 19 is shown connecting between a pair of headers 18 which are shown interconnecting with entrance manifold 16 and exit manifold 17. The expansion tank 20 is interconnected with exit manifold 17 by means of connecting duct 21 and the heat exchanger 15 is connected via entrance conduit 9 and return pipe 25 to the rest of the apparatus shown in FIG. 1.

Figure 4:
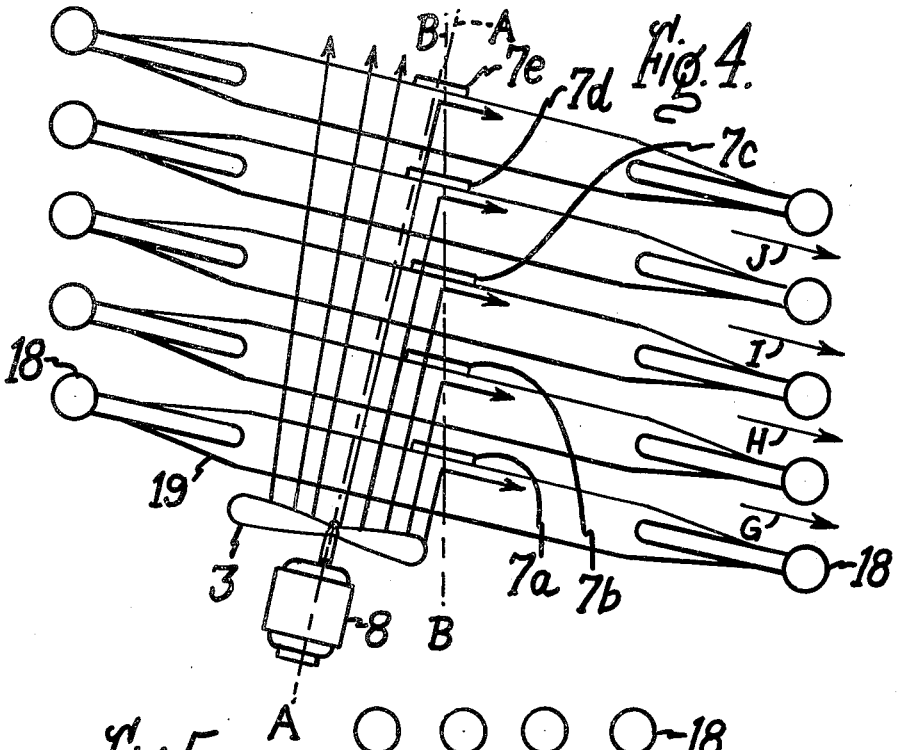
FIG. 4 is a side view of the heat exchanger of FIG. 2 including a schematic representation of the air deflection principle of the invention.

The heat exchanger of the invention improves over prior art heat exchangers by means of utilizing air deflectors 7 to direct the air blast from fan 8 in an efficient pattern as shown by directional arrows in FIG. 4. The fan 8 is mounted so that the air leaving the blade 3 is perpendicular to the first tube row. The center of the air blast is along the line A—A and is directed along deflectors *7a–7e* toward the last air deflector *7e*. The air deflectors *7a–7e* are arranged along the line B—B which is displaced from and intersects line A—A. The air blast to the left of the line A—A flows over the upper portion of the tubes 19. The air blast to the right of the line A—A strikes the air deflectors *7a–7e* and flows along the lower portion of tubes 19 and exits between headers 18 at the locations indicated by arrows G, H, I, and J. Because of the air deflection principles of the invention the air blast is directed over a much larger area of the surfaces of tubes 19 than if no air deflectors are used. For a heat exchanger constructed in accordance with the invention the natural convection rating was increased from 28750 watts to a forced air rating of 52465 watts by the use of only one fan. Since fewer fans are required with this invention, the capital costs of the apparatus is reduced appreciably so that the energy required to drive the fan motors is reduced considerably.

The use of five rows of tubes as shown in FIG. 1 is for the purpose of illustration only. Any number and length of tubes may be used to give the desired heat exchanger rating and it is not required that the line A—A intersect the air deflector *7e* of the top tube row. The invention is effective for example if the line B—B of air deflectors *7a–7e* is within a portion of the air blast and the line B—B is inclined at an angle to line A—A so that the line B—B of air deflectors *7a–7e* is not parallel to the line A—A through the center of the air blast. For heat exchangers having higher ratings the tubes 19 may be longer and both additional fans 8 and additional rows of air deflectors 7 may be utilized. It is to be noted that not all of the tubes have to contain air deflectors.

Figure 5:
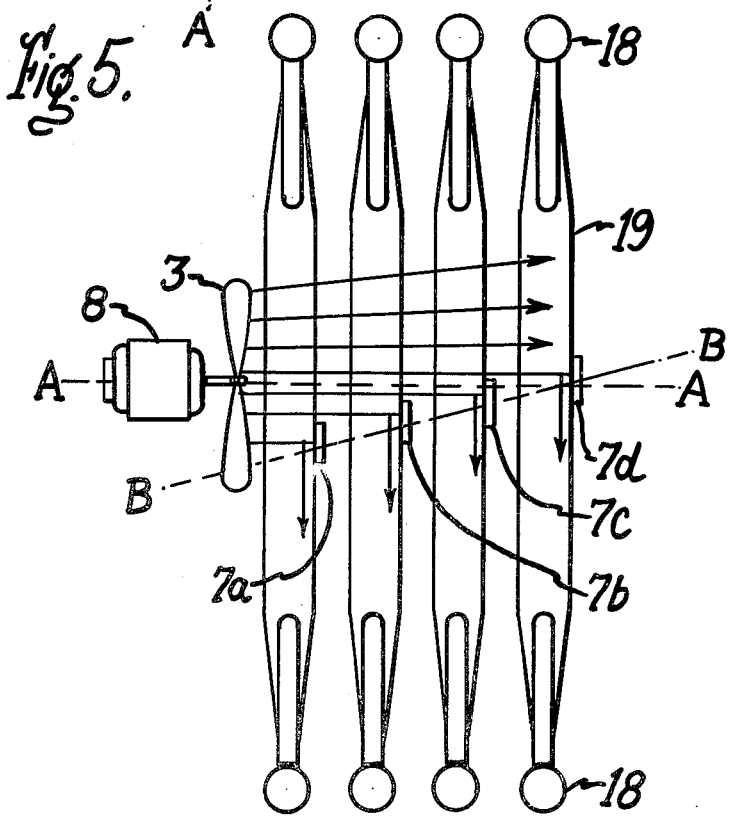
FIG. 5 is a side view of a further embodiment of the heat exchanger of the invention.

Although the improved heat exchanger of the invention is described for use with vaporization cooled transformers, this is by way of example only. The improved heat exchanger can also be used with oil filled convection transformers and for other type electrical apparatus employing either a liquid medium or a condensable coolant for cooling and insulating purposes as shown in the following embodiments wherein like reference numerals refer to elements previously described in the embodiments of FIGS. 1–4. The tubes 19 may also be vertical as commonly employed with oil-filled transformers as shown for example in FIG. 5. The air deflectors *7a–7d* are arranged to deflect the air blast over the lower portion of the tubes as shown by the directional arrows exhibiting a right angle flow pattern upon reflection from the deflectors.

Figure 6:
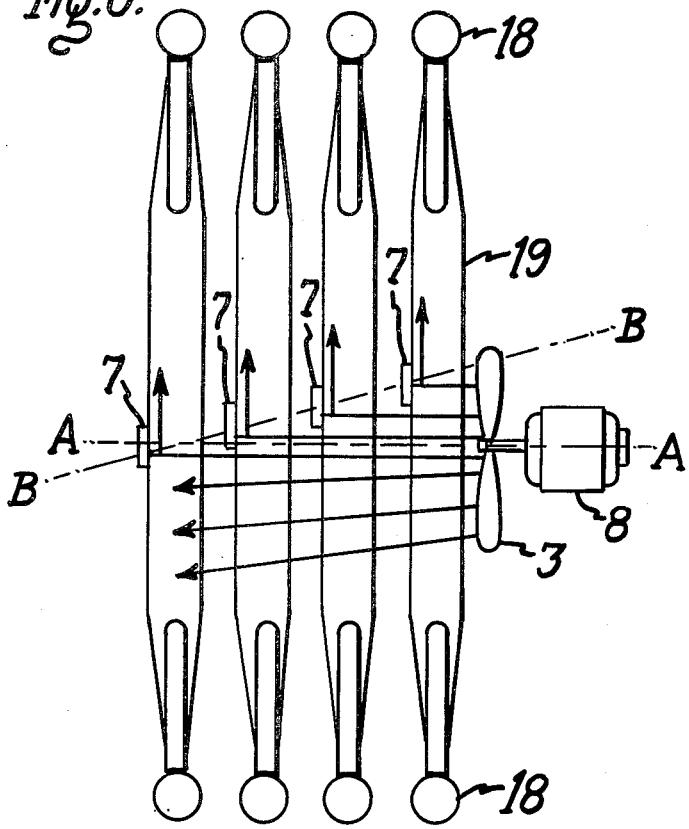
FIG. 6 is a side sectional view of an additional embodiment of the invention.

The air deflectors may also be utilized to direct the air blast in a vertical direction as shown by the directional arrows in FIG. 6.

Figure 7:
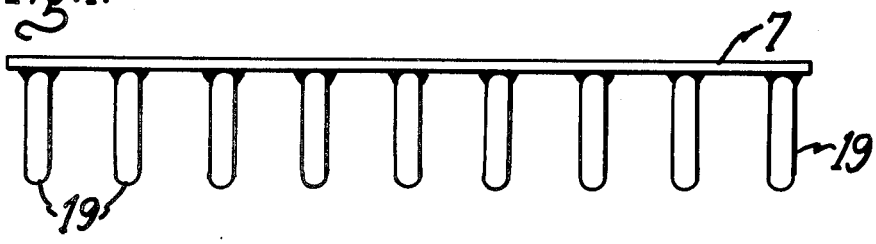
FIG. 7 is a sectional view along the line K—K of FIG. 1.
Figure 8:
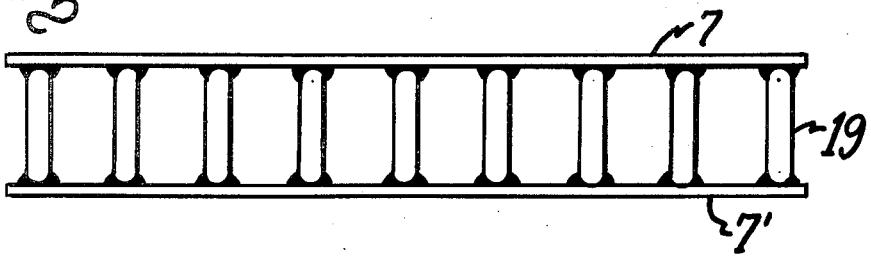
FIGS. 8–10 are side views of varying embodiments of the heat exchanger of the invention.
Figure 9:
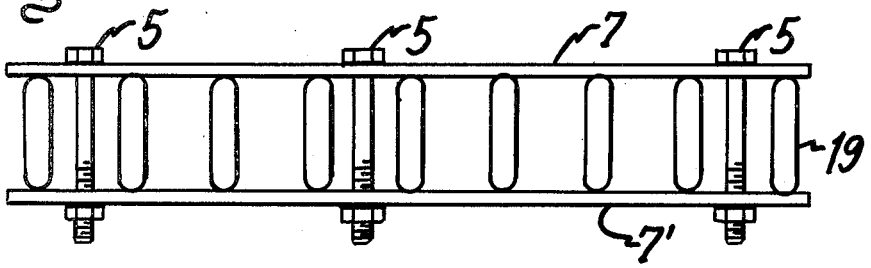
Figure 10:
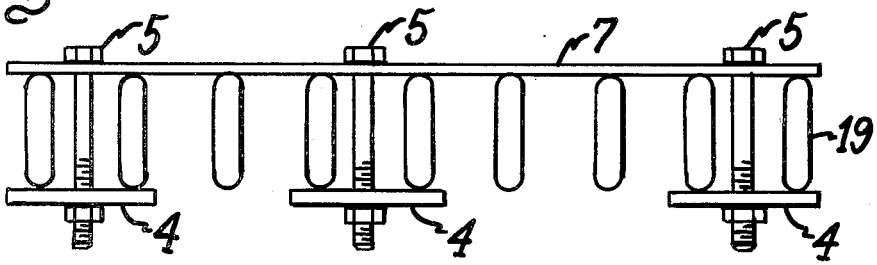

The attachment of air deflectors 7 to tubes 19 is shown in detail in FIG. 7. The air deflectors for the embodiments shown consist of a thin strip of metal welded to the tubes although other suitable materials such as plastics may also be employed. Additional air deflectors 7' may be attached to an opposing portion of the tubes 19 as shown in FIG. 8. The air deflectors may also be attached to the tubes with one or more bolts 5 as shown in the embodiments of FIGS. 9 and 10. FIG. 10 further shows one air deflector 7 bolted to one row of tubes 19 by means of a plurality of bolts 5 and bolt retainers 4.

I claim:

1. An improved heat exchanger of the type used for cooling electrical apparatus and having a plurality of headers and interconnecting cooling tubes said cooling tubes being arranged perpendicular to the headers and at least one fan to provide an airflow path over a first portion of the cooling tubes wherein the improvement comprises:

means to redirect the airflow along the axis of the cooling tubes for increasing the thermal rating of the heat exchanger.

2. The improved heat exchanger of claim 1 wherein the means to direct the airflow over a second portion of the cooling tubes comprises at least one air deflector within the airflow path and attached to at least one row of the cooling tubes.

3. The improved heat exchanger of claim 2 including air deflectors attached to a plurality of rows of the tubes arranged in a vertical array so that a plane passing through the air deflectors of succeeding rows in the array intersects a line through the airflow path.

4. The improved heat exchanger of claim 2 including a plurality of rows of cooling tubes and at least one air deflector per each row of the tubes.

5. The improved heat exchanger of claim 2 wherein at least one air deflector is attached to at least one of the cooling tubes by welding.

6. The improved heat exchanger of claim 2 wherein the air deflectors are removably attached to the cooling tubes by bolting.

7. The improved heat exchanger of claim 1 wherein the cooling tubes are arranged in a matrix configuration having a plurality of rows extending in a horizontal plane and a plurality of columns extending in a vertical plane and wherein the air direction means is attached to at least one of the rows in each column.

8. The improved heat exchanger of claim 7 wherein the matrix comprises an ordered array of said rows and columns such that each of said cooling tubes in one row is immediately subjacent a corresponding one of said cooling tubes in a succeeding row.

9. The improved heat exchanger of claim 7 wherein each of said cooling tubes in one row is subjacent one of cooling tubes in every other preceding row.

10. The improved heat exchanger of claim 1 wherein the cooling tubes are arranged in a matrix configuration having a plurality of rows extending in a vertical plane and a plurality of columns extending in a horizontal plane.

11. The improved heat exchanger of claim 10 wherein the matrix comprises an ordered array such that each of said cooling tubes in one of the rows is immediately subjacent a corresponding cooling tube in a succeeding row.

12. The improved heat exchanger of claim 10 wherein each of the cooling tubes in one row is subjacent one of the cooling tubes in every other preceding row.

13. An improved method of providing cooling air to a transformer heat exchanger of the type employing at least one cooling fan to remove heat from the exchanger tubes, the improvement comprising the steps of:

arranging a plurality of air deflectors one on each row of said tubes to redirect cooling air from said fan along the axis of a large number of said heat exchanger tubes.

14. The improved method of claim 13 including the steps of:

arranging the tubes in a matrix array of horizontal rows and vertical columns; and attaching one of said air deflectors to at least one of the rows of the tubes in each of said columns.

* * * * *